US008356554B2

(12) United States Patent
Nurminen et al.

(10) Patent No.: US 8,356,554 B2
(45) Date of Patent: Jan. 22, 2013

(54) ARRANGEMENT FOR SUPPORTING SHELL INTO WEAPON BARREL, AND SUPPORT MEMBER

(75) Inventors: Mika Nurminen, Nokia (FI); Pauli Rosvall, Huittinen (FI)

(73) Assignee: Patria Land Systems Oy, Helsinki (FI)

( * ) Notice: Subject to any disclaimer, the term of this patent is extended or adjusted under 35 U.S.C. 154(b) by 238 days.

(21) Appl. No.: 12/865,264

(22) PCT Filed: Jan. 30, 2009

(86) PCT No.: PCT/FI2009/050073

§ 371 (c)(1),
(2), (4) Date: Jul. 29, 2010

(87) PCT Pub. No.: WO2009/095536

PCT Pub. Date: Aug. 6, 2009

(65) Prior Publication Data

US 2010/0326309 A1 Dec. 30, 2010

(30) Foreign Application Priority Data

Jan. 31, 2008 (FI) ..... 20085082

(51) Int. Cl.
*F42B 30/10* (2006.01)

(52) U.S. Cl. ..... 102/445; 102/520

(58) Field of Classification Search ..... 102/445, 102/446, 473, 293, 520, 469, 483
See application file for complete search history.

(56) References Cited

U.S. PATENT DOCUMENTS

| | | | | | |
|---|---|---|---|---|---|
| 3,182,595 | A * | 5/1965 | Hassmann | ..... | 102/202 |
| 3,810,671 | A | 5/1974 | Jeffery | | |
| 3,825,980 | A | 7/1974 | Moore | | |
| 4,444,115 | A * | 4/1984 | Romer et al. | ..... | 102/431 |
| 4,616,554 | A | 10/1986 | Spink et al. | | |
| 4,770,099 | A * | 9/1988 | Brede et al. | ..... | 102/472 |
| 4,803,927 | A * | 2/1989 | Washburn | ..... | 102/434 |
| 4,938,146 | A * | 7/1990 | Gunther et al. | ..... | 102/439 |
| 5,463,958 | A * | 11/1995 | Roheim | ..... | 102/445 |
| 5,503,080 | A | 4/1996 | Goward et al. | | |
| 5,620,718 | A | 4/1997 | Bohm | | |
| 6,772,693 | B2 * | 8/2004 | Kuru et al. | ..... | 102/293 |
| 2004/0107857 | A1 * | 6/2004 | Kuru et al. | ..... | 102/293 |
| 2010/0269722 | A1 * | 10/2010 | Niemi et al. | ..... | 102/293 |

(Continued)

FOREIGN PATENT DOCUMENTS

| | | | |
|---|---|---|---|
| EP | 0488872 | A1 | 6/1992 |
| EP | 0687540 | A1 | 12/1995 |

(Continued)

*Primary Examiner* — Benjamin P Lee
(74) *Attorney, Agent, or Firm* — Birch, Stewart, Kolasch & Birch, LLP

(57) ABSTRACT

The invention relates to an arrangement for supporting a shell (1) into the barrel of a breech-loading weapon and to a support member for supporting a shell. The arrangement comprises a flanged support element (5), to which a fastening element is connected with threads. A sleeve-like clamping element is arranged around the fastening element. Both have grooves for tail fins of the shell (1). The support member (5) has a support element, to which a fastening element is connected with threads and on top of which a sleeve-like support element is arranged.

20 Claims, 6 Drawing Sheets

U.S. PATENT DOCUMENTS

2010/0282114 A1* 11/2010 Reunamaki ..... 102/473
2010/0288112 A1* 11/2010 Reunamaki et al. ..... 89/27.13
2010/0288150 A1* 11/2010 Kautto et al. ..... 102/293
2010/0288153 A1* 11/2010 Reunamaki et al. ..... 102/473
2010/0300321 A1* 12/2010 Johansson ..... 102/481
2010/0326310 A1* 12/2010 Tiainen et al. ..... 102/473

FOREIGN PATENT DOCUMENTS

WO WO 98/33018 A1 7/1998

* cited by examiner

ARRANGEMENT FOR SUPPORTING SHELL INTO WEAPON BARREL, AND SUPPORT MEMBER

BACKGROUND OF THE INVENTION

The invention relates to an arrangement for supporting a shell into the barrel of a breech-loading weapon, the arrangement comprising a support member to be fastened to a shell tail, the support member comprising a support element provided with a rim flange and means for fastening the support element to the shell tail, and a firing member in the support element for firing the actual primer of the shell for firing the shell.

The invention further relates to a support member to be fastened to a shell tail for supporting a shell into the barrel of a breech-loading weapon, comprising a support element provided with a rim flange and means for fastening the support element to the shell tail, and a firing member in the support element for firing the actual primer of the shell for firing the shell.

Mortars are nowadays mounted on movable bases, allowing them to be moved from one place to another and, on the other hand, allowing them to be rapidly moved from the emplacement. A problem in such solutions is the ability of said base, i.e. vehicle, to defend itself against possible attacks, and the use thereof for destroying close-range targets on the ground. A moving base provided with a heavy shell mortar is normally unable to carry heavy defensive facilities in addition to the shell mortar, instead, it is at most provided with a heavy machine gun or corresponding lighter armature. In such a situation, the vehicle needs to be able to use the mortar for also firing horizontally or below it, for which normal shells and shell mortars are not suited. A shell inside a normal mortar having a smooth barrel is able to move when the shell mortar is oriented in the horizontal direction or below it in the barrel in such a manner that it either falls from the barrel or moves to such an extent that the shell does not go off. This problem is solved in the solution of U.S. Pat. No. 5,503,080, disclosing a support member/control piece to be fastened to the tail of a conventional shell by means of a friction-based clip bond. However, such a friction-based bond is not as such very dependable and the tolerances of both the manufacture of the shell and the manufacture of the control piece cause variations in the fastening force and the stability.

WO application FI 98/00064 presents a solution, wherein a control piece is fastened to the tail of a conventional shell by means of a mechanical locking, wherein the locking piece breaks in connection with firing. In this solution, the fastening piece between the shell and the control piece has to be replaced with a new one after the shell has been fired.

BRIEF DESCRIPTION OF THE INVENTION

An object of the present invention is to provide an arrangement and a support member allowing a shell of a shell mortar to be securely and reliably kept in the right position in the barrel of a breech-loading shell mortar and enabling its reliable and secure operation in all situations. Another object of the invention is to provide an arrangement and a support member wherein the support member may be used a plurality of times without having to replace the parts thereof.

The arrangement of the invention is characterized in that the means for fastening the support element to the shell tail comprise a sleeve-like fastening element having grooves for the tail fins of the shell and, between the grooves, jaws settling onto the shell tail tube, the outer surfaces of the jaws being outwardly bevelled at least up to the ends of the jaws, that the fastening element and the support element are provided with matching threads in such a manner that rotating them relative to one another changes their axial position relative to one another, a sleeve-like clamping element placed around the fastening element and comprising grooves for the tail fins of the shell and able to move in the axial direction thereof relative to the fastening element, whereby rotating the support element relative to the fastening element in such a manner that the support element shifts towards the fastening element, at the same time pushing the clamping element in the same direction in such a manner that the clamping element is pushed along the outwardly bevelled surfaces of the jaws of the clamping element and presses the jaws of the fastening element to the shell tail.

The support member of the invention is characterized in that the means for fastening the support element to the shell tail comprise a sleeve-like fastening element having grooves for the tail fins of the shell and, between the grooves, jaws settling onto the shell tail tube, the outer surfaces of the jaws being outwardly bevelled at least up to the ends of the jaws, that the fastening element and the support element are provided with matching threads in such a manner that rotating them relative to one another changes their axial position relative to one another, a sleeve-like clamping element placed around the fastening element and comprising grooves for the tail fins of the shell and able to move in the axial direction thereof relative to the fastening element, whereby rotating the support element relative to the fastening element in such a manner that the support element shifts towards the fastening element, at the same time pushing the clamping element in the same direction in such a manner that the clamping element is pushed along the outwardly bevelled surfaces of the jaws of the clamping element and presses the jaws of the fastening element to the shell tail.

An essential idea of the invention is to fasten the support member to the shell tail by pressing the jaws of the fastening element protruding between the shell tail and provided in the support member against the shell tail in such a manner that they are compressed thereto with a sufficient force. A further essential idea of the invention is to compress the jaws of the fastening element against the shell tail by compressing the jaws with a clamping element outside of the fastening element, at least the fastening element, preferably both, comprising bevelled, preferably conical surfaces in such a manner that when the fastening member is pulled to the inside of the clamping element, the inner surfaces of the clamping element press the jaw of the fastening element at a corresponding point against the shank of the shell tail and preferably finally partly inside the shank. A still further essential idea of the invention is to connect the fastening element to a fastening part in the middle of the support element provided with a flange with mutually matching threads provided in both and to perform said tightening by rotating the flanged support element around the longitudinal axis of the shell. An advantage of the invention is that irrespective of the manufacturing tolerances, the support member can be fastened to the shell tail always using the same force, since the rotational force of the support element can be arranged to be of the same magnitude every time. Furthermore, the locking can be made sufficiently reliable, and the support member is easy to take into use again simply by rotating the fastening element relative to the support element in an opposite direction, until it can again be pushed onto the tail of a new shell. A further advantage of the invention is that such a support member can be reused several times without having to replace or add any components thereto.

BRIEF DESCRIPTION OF THE FIGURES

The invention will be described in more detail in the attached drawings, wherein FIG. 1 schematically shows a shell in a mortar barrel, provided with a support member according to the invention.

DETAILED DESCRIPTION OF THE INVENTION

Figure 1:
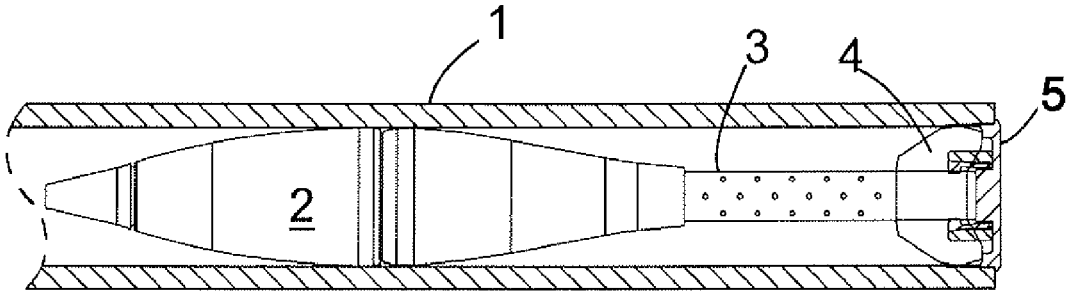

In all figures, the same reference numerals are used for the same parts for the sake of clarity.

FIG. 1 shows a barrel 1 of a breech-loading weapon, typically a shell mortar, with a shell 2 inside thereof. A control piece 5, shown in more detail in FIGS. 2 to 5, is arranged behind a tail 4 fastened to a tail tube 3 of the shell 2. The lock of the barrel of the shell mortar and the other details thereof are not shown in any more detail, since they are generally known per se, and are not as such essentially associated with the actual invention.

Figure 2:
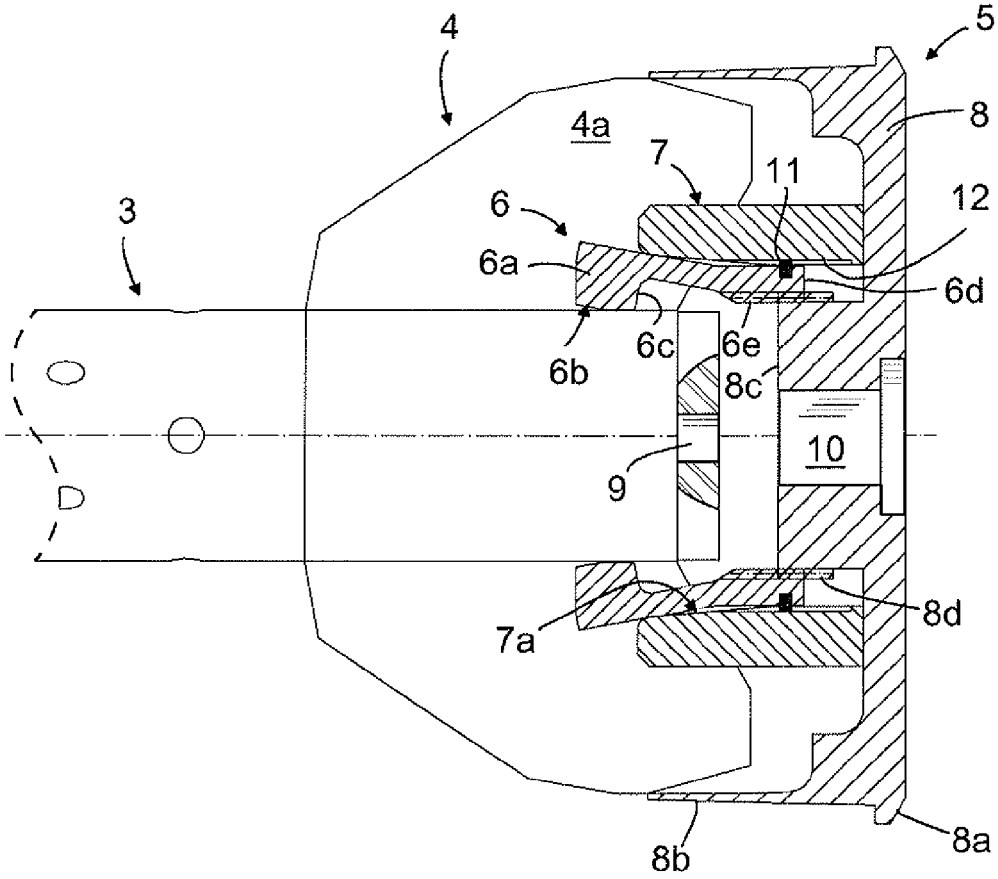
FIG. 2 schematically shows a support element of the invention mounted onto the shell tail before the tightening thereof.

FIG. 2 schematically shows a cross-section of a support member of the invention mounted in position onto the tail of a shell at the initial stage of the mounting. The support member 5 comprises a fastening element 6, a clamping element 7 and an actual support element 8, which supports the shell tail relative to the barrel of the mortar.

Figure 4:
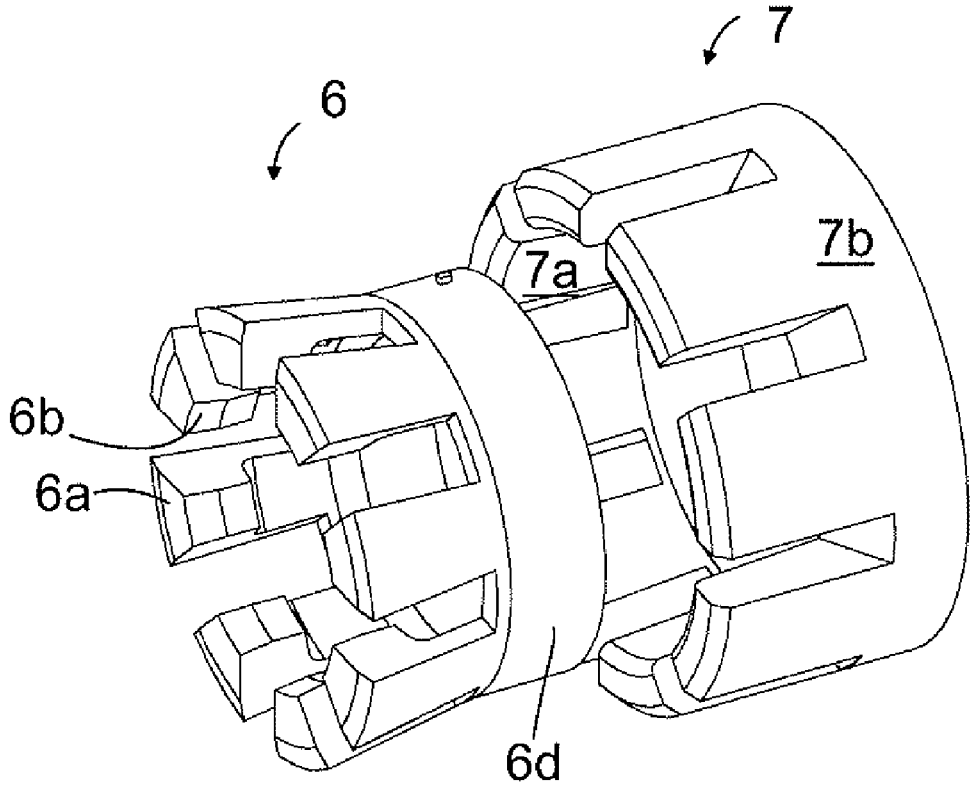
FIG. 4 schematically shows a perspective view of a fastening element and a clamping element of a support member according to the invention.
Figure 5:
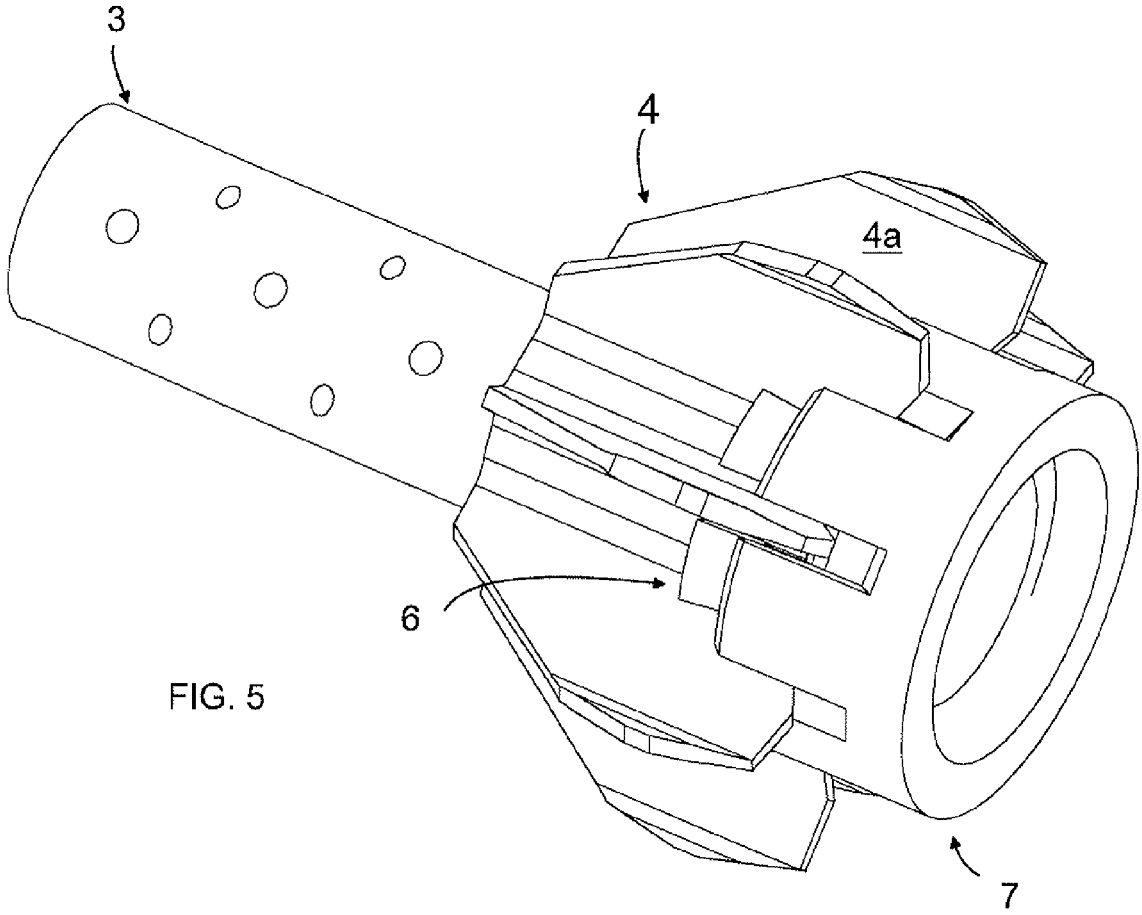
FIG. 5 schematically shows the position of a fastening element and a clamping element of a support member according to the invention relative to one another when placed in a shell tail before the support element is tightened into the operational position.

The fastening element 6 comprises separate jaws 6*a* to be described later in FIGS. 4 and 5 and comprising tips 6*b* situated to the side of the shell tail tube. The tips 6*b*, in turn, comprise mating surfaces 6*c* facing behind the shell towards the support element 8. As shown in FIGS. 4 and 5, between the jaws 6*a* is a groove into which fins 4*a* of the shell tail 4 are able to protrude in such a manner that the shell tail and the fastening element 6 cannot rotate substantially relative to one another. The fastening element 6 further comprises an integral annular part 6*d*, to which the jaws 6*a* closely adjoin. In addition, the fastening element 6 has an inner thread 6*e*. Furthermore, the outer surface of the jaws 6*a* of the fastening element 6 is outwardly bevelled from the annular part 6*d* towards the end of the jaws 6*a*, preferably part of a conical surface.

At its simplest, the clamping element 7 is a separate sleeve placed outside the fastening element 6 around it. The clamping element 7 comprises, in a corresponding manner, a preferably conical inner surface bevelled towards the shell 2 and in contact with the outer surface of the jaws 6*a*. At the start of the mounting of the support member 5, the mutual position of the clamping element 7 and the fastening element 6 is such that the jaws 6*a* of the clamping element 6 are sufficiently far from one another in the radial direction to fit the shell tail tube between the jaws. In the manner shown in FIGS. 4 and 5, the clamping element 7 is provided correspondingly with grooves into which the tail fins 4*a* of the shell fit and, correspondingly, the clamping element is also substantially unable to rotate relative to the fins 4*a* of the tail 4.

The support element 8 has a flange 8*a* that serves to keep the shell in the mortar barrel in position by means of the groove therein even when the mortar barrel is oriented obliquely downwards. Furthermore, it may comprise a short control edge 8*b*, inside which the shell tail 4 settles. Furthermore, the middle of the support element 8 is provided with a tightening part 8*c*, threads 8*d* being provided on the outer surface thereof. The threads 8*d*, in turn, match the inner threads 6*e* of the fastening element 6 in such a manner that by rotating the fastening element 6 and the support element 8 relative to one another, their position in the direction of their mutual axis changes depending on the rotational direction in one direction or another. FIG. 2 further shows a partial cross-section of a primer 9 in the tail tube 3 of the shell, normally used for firing the shell. FIG. 2 further shows a firing member 10 in the support element 8, by means of which the primer of the shell is fired when the support element is mounted in the shell tail. Different alternative embodiments of a firing member are disclosed in U.S. Pat. No. 6,257,148, for example. With the shell in the barrel, the firing pin of the mortar hits the firing member, which transfers the firing to the primer of the shell making it fire and, thus, makes the takeoff charge of the shell fire.

FIG. 2 also shows a control pin 11 in the fastening element 6 and, correspondingly, a groove 12 in the clamping element 7. The use of these enables the locking of the fastening element and the clamping element relative to one another irrotationally in such a manner that they are always in the correct position relative to one another. This being so, when mounting the support member, the mechanic does not have to separately arrange them into position, but they remain in the correct position relative to each other both with the support member separate and during mounting. Instead of the control pin and the groove, other locking members, known per se, may also be used for locking the fastening element and the clamping element irrotationally relative to one another, such as rifles, shape locking etc.

Figure 3:
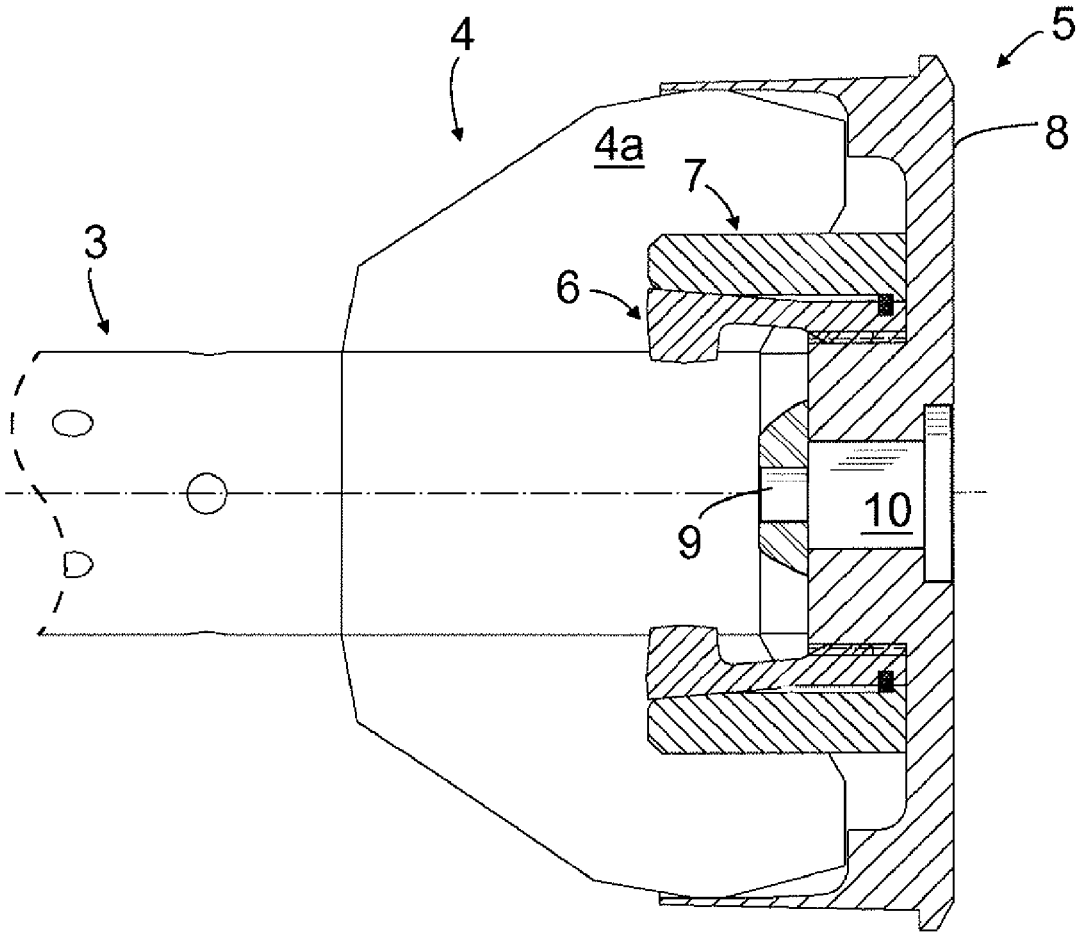
FIG. 3 schematically shows a support element of the invention mounted onto the shell tail and tightened into its operational position.

In the situation shown in FIG. 2, the mounting of the support member is just beginning. In this situation, when the support element 8 is rotated in the correct direction relative to the thread, the support element 8 shifts towards the fastening element 6 at the same time compressing the clamping element 7 in the same direction. As the clamping element 7 moves to the left in the situation shown in FIG. 2 at the same time as the fastening element 6 remains in position, the bevelled wedge-like inner surface 7*a* of the support element 7 pushes the jaws 6*a* of the fastening element in the radial direction towards the shell tail tube, making the tip 6*b* of the jaws compress from the surface of the shell tail tube to the inside. At the same time as this happens, the mating surfaces 6*c* lock the jaws of the fastening element and thus the entire support member 5 steadily to the shell tail tube 3. When the support element 8 has been rotated a sufficient number of turns, the situation shown in FIG. 3 is encountered, wherein the tips of the jaws of the fastening element are properly compressed to the shell tail tube, and the travel of the support element 8 relative to the fastening element 6 and, correspondingly, to the clamping element 7, is prevented, the inner surface of the support element 8 being in contact with the farther surface of both. In this situation, the shell is ready to be fed into the mortar barrel and to be fired.

Since the position of the support element 8 relative to the fastening element 6 is precisely defined in accordance with FIG. 3, and, correspondingly, the position of the clamping member 7 relative to the fastening element 6 is precisely defined, the tips 6*b* of the jaws 6*a* of the fastening element 6 are pressed into the shell tail tube always in the same manner and the detachment force required as a result thereof, with which the support element can be withdrawn from the shell tail tube, is always substantially the same. In this way, the substantially same output force required for the shells is obtained, and thus the impact accuracy of the shells improves.

FIG. 4 schematically shows a perspective view of a fastening element and a clamping element of a support member according to the invention.

As the figure shows, the fastening element 6 is provided jaws 6*a* at a distance from each other, and tips 6*b* shown therein. Between the jaws 6*a* are shown grooves, into which the shell tail fins may settle. Furthermore, an annular integral part 6*d* is shown, to which the jaws 6*a* are attached. Correspondingly, an integral annular part 7*b* and grooves are shown in the clamping element 7, between which grooves the parts of the clamping element settle against the outer surface of the jaws 6*a* of the fastening element for compression thereof towards the shell tail.

FIG. 5, in turn, shows a perspective view of how the fastening element 6 and the clamping element 7 settle relative to the tail 4 and the fins 4*a* when the mounting of the support member to the shell tail begins. It also shows how the tail fins 4*a* of the shell tail settle into the grooves of both the fastening element 6 and the clamping element 7. It also shows that, at the initial stage of the mounting, the grooves of the support element 7 are at a distance from the shell tail fins 4*a* in manner allowing the support element 7 to be compressed towards the shell in the manner described previously in connection with FIGS. 2 and 3.

Figure 6:
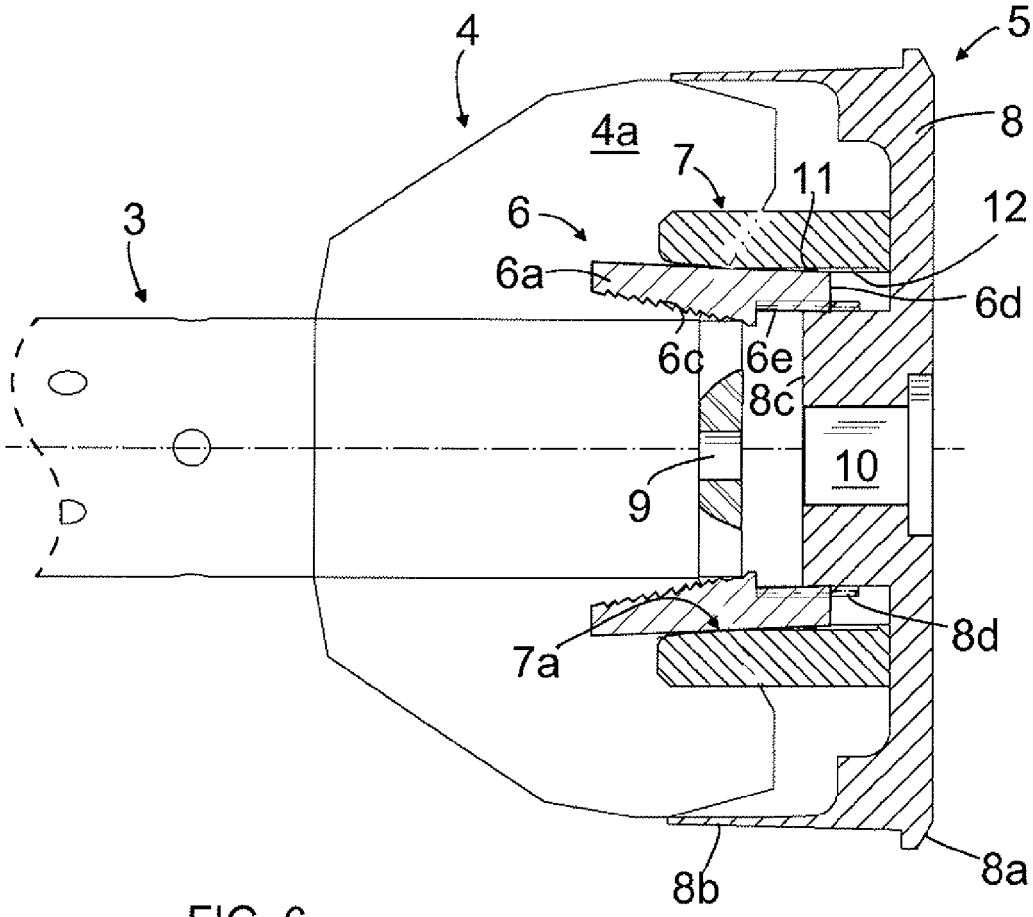
FIG. 6 schematically shows still another embodiment of the invention.

FIG. 6 schematically shows still another embodiment of the invention, wherein the inner sides of the jaws 6*a* of the fastening element 6 are bevelled longitudinally outwardly in such a manner that the opening therebetween widens upwardly, i.e. towards the shell. Furthermore, the inner surfaces, i.e. mating surfaces 6*c* of the jaws are grooved or rifled in the transverse direction of the jaws or they are provided with separate projections, whereby the jaws grip the tail tube 3 of the shell when the fastening element 6 is pushed onto the tail tube 3 in such a manner that the tail fins 4*a* of the tail 4 remain between the jaws 6*a*. The jaws may also be shaped and dimensioned in a manner allowing them to slightly bend outwards. When the support element 8 is threaded into the threads of the fastening element 6, it pushes the clamping element 7 against the bevelled upper surfaces of the jaws. In this case, the jaws 6*a* are compressed against the outer surface of the tail tube 3 and the rifles or projections of the inner surface may even penetrate into the tail tube fastening the support member 5 steadily to the shell.

In the longitudinal direction of the barrel, the support element 8 may be shorter or longer. Similarly, the lengths of the clamping element 7 and the fastening element 6 may vary, as long as the position of the tips or projections of the fastening element relative to the shell tail is such that when the shell is detached, its tail is not damaged. Restricting the position of the support element 8 in such a manner that as a result thereof, the compression distance in the radial direction of the jaws of the fastening element is always substantially the same, may naturally be replaced with some other manner, such as by using a given type of constant moment when rotating the support element 8 during the fastening or in some other suitable manner. However, it is essential that all parts of the support member 5 are manufactured from a material that endures the forces generated from the firing of the shell without breaking during more than one firing. The tips 6*b* of the jaws of the fastening member may be provided with projections, rifles, or other corresponding solutions improving the holding power, whereby for instance a coarse toothing on the surface on the side of the tail tube of the tips 6*b* increases the holding power and, thus, the detachment force required. Similarly, for making the clamping force constant, it is clear that the shape of the jaws 6*a* should be either relatively slowly evenly widening or of the same size at least along the distance the jaw tip sinks in the shell tail during the fastening.

It is obvious to a person skilled in the art that as technology advances, the basic idea of the invention can be implemented in a variety of ways. Consequently, the invention and its embodiments are not restricted to the above examples, but may vary within the scope of the claims.

The invention claimed is:

1. An arrangement for supporting a shell into the barrel of a breech-loading weapon, the arrangement comprising a support member to be fastened to a shell tail, the support member comprising:

a support element provided with a rim flange;

a fastening device configured to fasten the support element to the shell tail;

a firing member in the support element for firing the actual primer of the shell for firing the shell, wherein the fastening device comprises a sleeve-like fastening element having grooves for the tail fins of the shell and, between the grooves, jaws settling onto the shell tail tube, the outer surfaces of the jaws being outwardly bevelled at least up to the ends of the jaws, and wherein the fastening element and the support element are provided with matching threads in such a manner that rotating them relative to one another changes their axial position relative to one another; and a sleeve-like clamping element placed around the fastening element and comprising grooves for the tail fins of the shell and able to move in the axial direction thereof relative to the fastening element, whereby rotating the support element relative to the fastening element in such a manner that the support element shifts towards the fastening element, the support element at the same time pushing the clamping element in the same direction in such a manner that the clamping element is pushed along the outwardly bevelled surfaces of the jaws of the fastening element and presses the jaws of the fastening element to the shell tail.

2. An arrangement as claimed in claim 1, wherein the jaws of the fastening element are provided with tips facing towards the shell tail tube, which are forced towards the shell tail tube as the clamping element is forced onto the jaws.

3. An arrangement as claimed in claim 2, wherein the tips of the jaws of the fastening element are provided with rifles or other corresponding projections, which penetrate at least partly into the shell tail tube as the clamping element is forced onto the jaws.

4. An arrangement as claimed in claim 1, wherein the inner surfaces of the jaws of the fastening element are outwardly bevelled away from the support element and that the inner surfaces of the jaws are provided with rifles or other corresponding projections, which penetrate at least partly into the shell tail tube as the clamping element is forced onto the jaws.

5. An arrangement as claimed in any one of claims 1 to 4, wherein the inner surface of the clamping element is outwardly bevelled at least at its end on the side of the jaws of the fastening element.

6. An arrangement as claimed in claim 5, wherein the bevelled surfaces of both the fastening element and the clamping element are parts of a cone.

7. An arrangement as claimed in claim 5, wherein the grooves of the fastening element are dimensioned to settle against the rear surface of the tail fins of the shell during the mounting of the fastening element.

8. An arrangement as claimed in claim 7, wherein the fastening element and the support element have mating surfaces that, when coming into contact with each other, stop a movement between the fastening element and the support element in the axial direction, whereby the position of the clamping element relative to the fastening element is always the same at the end of the mounting and the clamping force to the shell tail is thus substantially constant.

9. An arrangement as claimed in any one of claims 1 to 4, wherein the grooves of the fastening element are dimensioned to settle against the rear surface of the tail fins of the shell during the mounting of the fastening element.

10. An arrangement as claimed in claim 9, wherein the fastening element and the support element have mating surfaces that, when coming into contact with each other, stop a movement between the fastening element and the support element in the axial direction, whereby the position of the clamping element relative to the fastening element is always the same at the end of the mounting and the clamping force to the shell tail is thus substantially constant.

11. A support member to be fastened to a shell tail for supporting a shell into the barrel of a breech-loading weapon, comprising:

a support element provided with a rim flange;

a fastening device configured to fasten the support element to the shell tail;

a firing member in the support element for firing the actual primer of the shell for firing the shell, wherein the fastening device comprises a sleeve-like fastening element having grooves for the tail fins of the shell and, between the grooves, jaws settling onto the shell tail tube, the outer surfaces of the jaws being outwardly bevelled at least up to the ends of the jaws, and wherein the fastening element and the support element are provided with matching threads in such a manner that rotating them relative to one another changes their axial position relative to one another; and a sleeve-like clamping element placed around the fastening element and comprising grooves for the tail fins of the shell and able to move in the axial direction thereof relative to the fastening element, whereby rotating the support element relative to the fastening element in such a manner that the support element shifts towards the fastening element, the support element at the same time pushing the clamping element in the same direction in such a manner that the clamping element is pushed along the outwardly bevelled surfaces of the jaws of the fastening element and presses the jaws of the fastening element to the shell tail.

12. A support member as claimed in claim 11, wherein the jaws of the fastening element have tips facing towards the shell tail tube and are forced towards the shell tail tube when the clamping element is forced onto the jaws.

13. A support member as claimed in claim 12, wherein the tips of the jaws of the fastening element are provided with rifles or other corresponding projections, which penetrate at least partly into the shell tail tube.

14. A support member as claimed in claim 11, wherein inner surfaces of the jaws of the fastening element are outwardly bevelled away from the support element and that the inner surfaces of the jaws are provided with rifles or other corresponding projections, which penetrate at least partly into the shell tail tube when the clamping element is forced onto the jaws.

15. A support member as claimed in any one of claims 11 to 14, wherein the inner surface of the clamping element is outwardly bevelled at least at the end thereof on the side of the jaws of the fastening element.

16. A support member as claimed in claim 15, wherein the bevelled surfaces of both the fastening element and the clamping element are parts of a cone.

17. A support member as claimed in claim 15, wherein the grooves of the fastening element are dimensioned to settle against the rear surface of the tail fins of the shell during the mounting of the fastening element.

18. A support member as claimed in claim 17, wherein the fastening element and the support element have mating surfaces that, when coming into contact with each other, stop a movement between the fastening element and the support element in the axial direction, whereby the position of the clamping element relative to the fastening element is always the same at the end of the mounting and the clamping force to the shell tail is thus substantially constant.

19. A support member as claimed in any one of claims 11 to 14, wherein that the grooves of the fastening element are dimensioned to settle against the rear surface of the tail fins of the shell during the mounting of the fastening element.

20. A support member as claimed in claim 19, wherein the fastening element and the support element have mating surfaces that, when coming into contact with each other, stop a movement between the fastening element and the support element in the axial direction, whereby the position of the clamping element relative to the fastening element is always the same at the end of the mounting and the clamping force to the shell tail is thus substantially constant.

* * * * *